US009216344B1

(12) United States Patent
Peale

(10) Patent No.: US 9,216,344 B1
(45) Date of Patent: Dec. 22, 2015

(54) TILE ALIGNMENT AND MATCHING GAME

(71) Applicant: Robert E. Peale, Carmel, IN (US)

(72) Inventor: Robert E. Peale, Carmel, IN (US)

( * ) Notice: Subject to any disclaimer, the term of this patent is extended or adjusted under 35 U.S.C. 154(b) by 0 days.

(21) Appl. No.: 14/506,630

(22) Filed: Oct. 4, 2014

(51) Int. Cl.
*A63F 9/20* (2006.01)
*A63F 3/00* (2006.01)
*A63F 9/12* (2006.01)

(52) U.S. Cl.
CPC ..... *A63F 3/00697* (2013.01); *A63F 9/1252* (2013.01); *A63F 2003/00725* (2013.01); *A63F 2009/122* (2013.01); *A63F 2009/126* (2013.01); *A63F 2009/1216* (2013.01); *A63F 2009/1256* (2013.01); *A63F 2009/1264* (2013.01)

(58) Field of Classification Search
CPC ..... A63F 2009/126; A63F 2009/1264; A63F 2009/1256; A63F 2009/122; A63F 2009/1216; A63F 2009/1208; A63F 9/1252; A63F 9/20
USPC ..... 273/293, 294, 276, 290; 446/104, 118, 446/122, 124, 125; D21/489, 491, 500, 391
See application file for complete search history.

(56) References Cited

U.S. PATENT DOCUMENTS

| | | | | | |
|---|---|---|---|---|---|
| 1,142,471 | A | * | 6/1915 | White | 446/122 |
| 1,996,722 | A | * | 4/1935 | Gilbert et al. | 446/116 |
| 3,376,042 | A | * | 4/1968 | Dunlap et al. | 273/282.1 |
| 3,481,603 | A | * | 12/1969 | Sugden | 273/271 |
| 3,649,026 | A | | 3/1972 | Breslow | |
| 3,844,568 | A | | 10/1974 | Armstrong | |
| 3,849,912 | A | * | 11/1974 | Kemnitzer | 434/98 |
| 3,895,456 | A | | 7/1975 | Fabre | |
| 4,955,615 | A | | 9/1990 | Eck | |
| 2005/0130726 | A1 | | 6/2005 | Stewart | |

* cited by examiner

*Primary Examiner* — Benjamin Layno
(74) *Attorney, Agent, or Firm* — Richard L. Miller

(57) ABSTRACT

A set of tiles interconnecting to each other in a continuous end-to-end manner. Each tile has a body. The body of each tile has a specific amount of through bores, a pair of blind bores, and a pair of pins. The pin of the body of one tile sits in the blind bore of the body of another tile. A portion of the specific amount of through bores in the body of the one tile align with a similar portion of the specific amount of through bores in the body of the another tile.

15 Claims, 9 Drawing Sheets

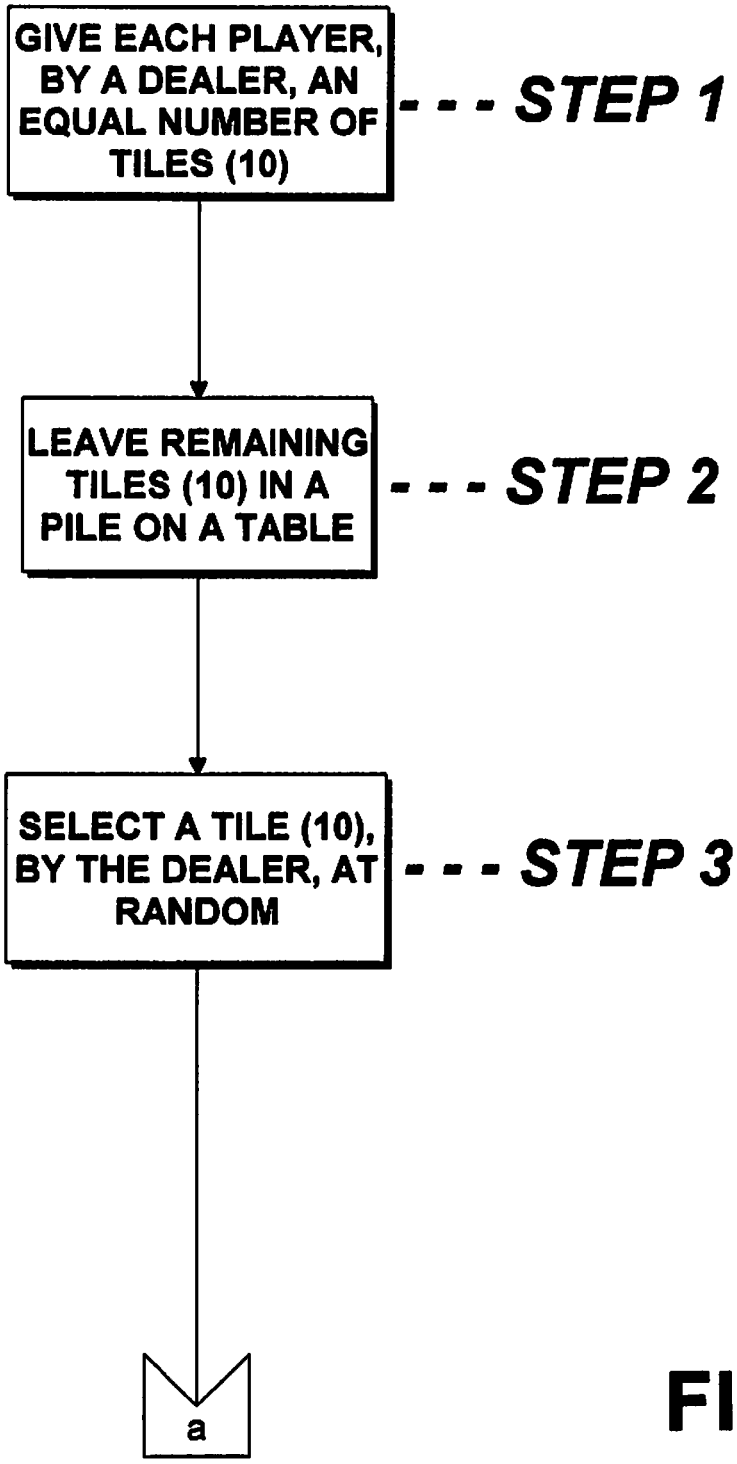
FIG. 9-A

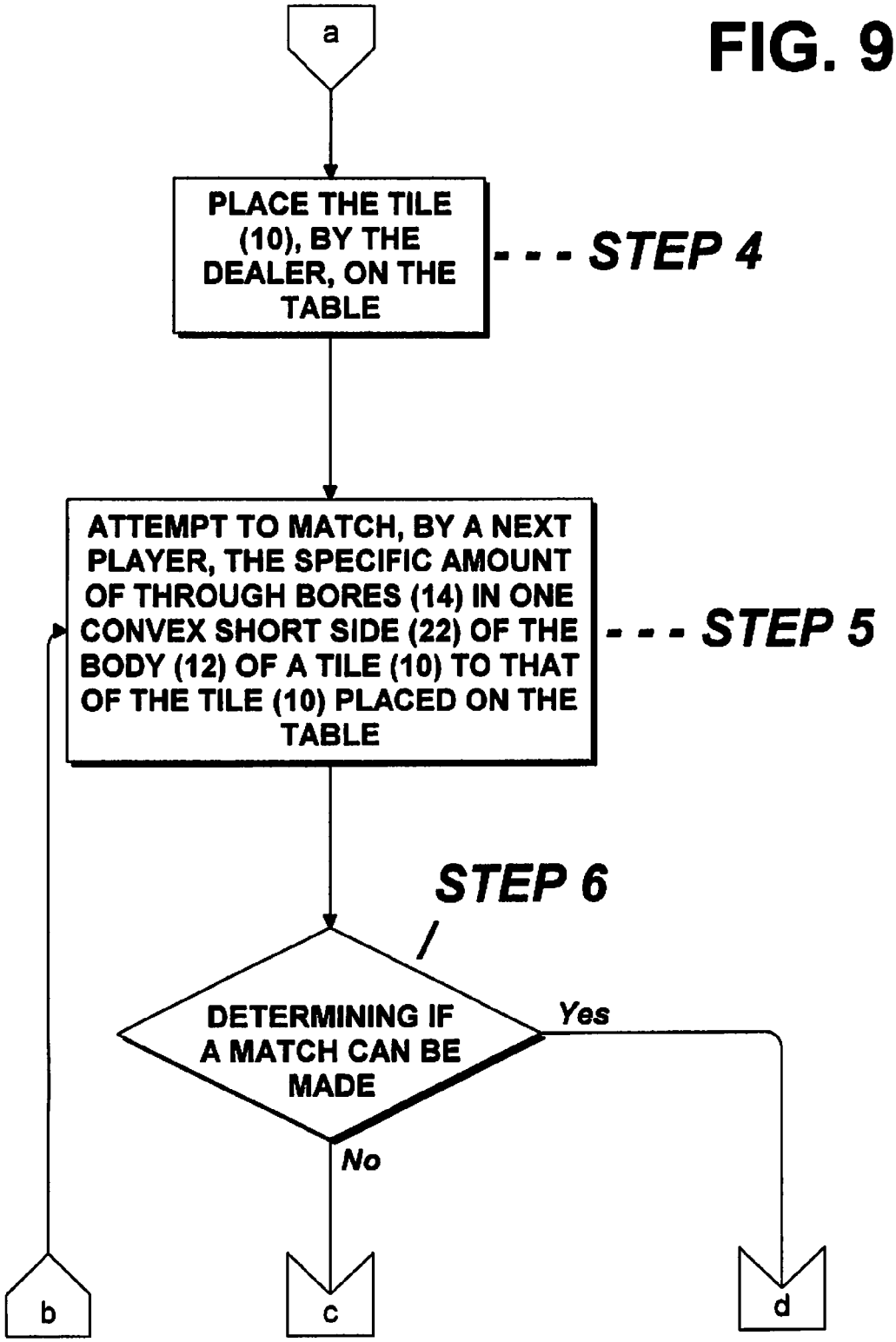
FIG. 9-B

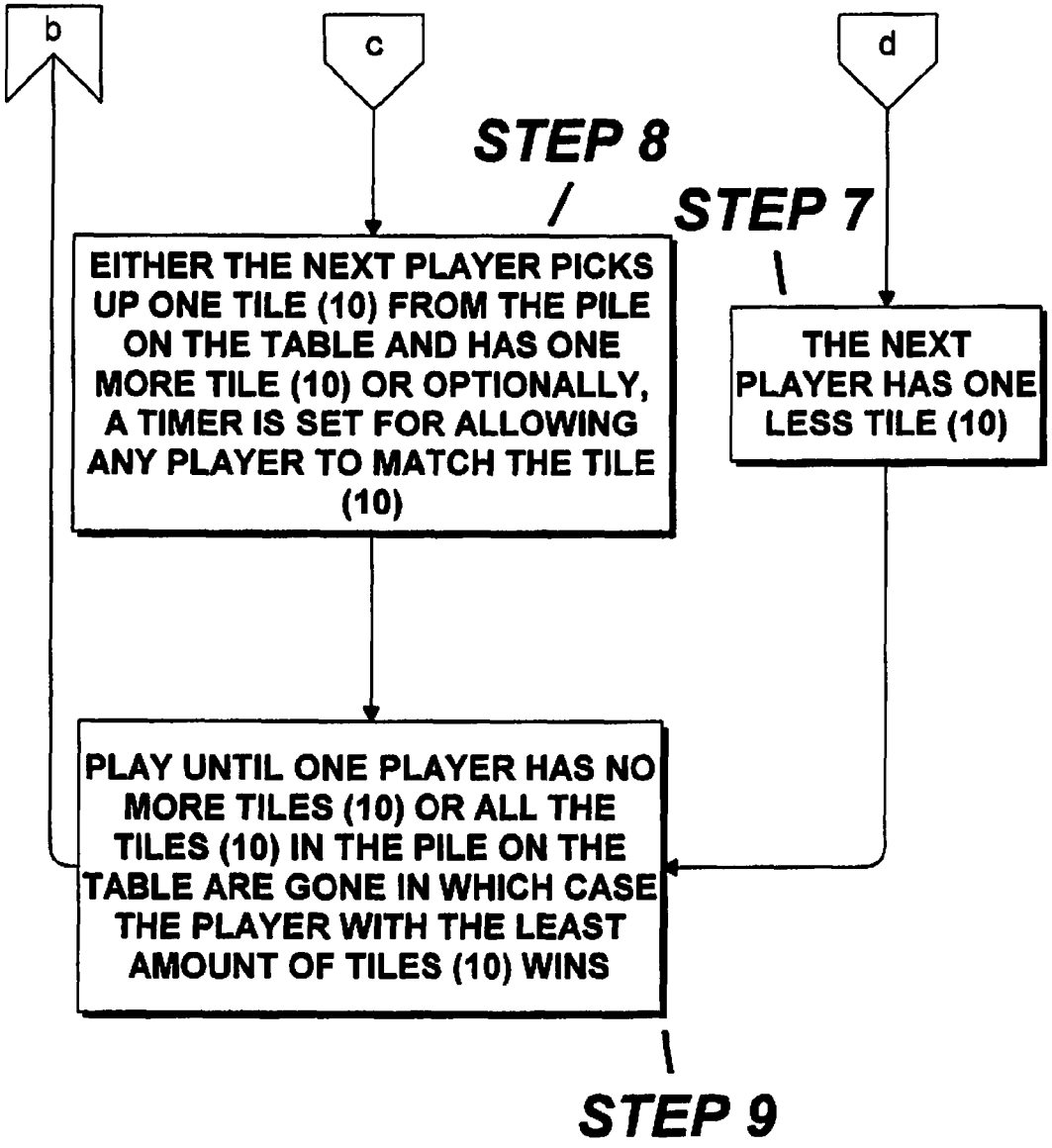
FIG. 9-C

TILE ALIGNMENT AND MATCHING GAME

BACKGROUND OF THE INVENTION

1. Field of the Invention

The present invention relates to a game, and more particularly, a tile alignment and matching game.

2. Description of the Prior Art

Numerous innovations for table games have been provided in the prior art that will be described. Even though these innovations may be suitable for the specific individual purposes to which they address, however, they differ from the present invention.

A FIRST EXAMPLE, U.S. Patent Office Document U.S. Pat. No. 3,649,026, Published/Issued on Mar. 14, 1972, to Breslow teaches a game characterized by the provision of plural playing tiles for each player with peripheral notches in the playing tiles and grooves in the faces of the playing tiles and a plurality of preferably resilient endless strands, such as rubber bands, the object of the game being for each player to wrap the rubber bands about the tiles in the pattern indicated by the grooves on the opposed faces of the tiles without repeating any pattern.

A SECOND EXAMPLE, U.S. Patent Office Document U.S. Pat. No. 3,844,568, Published/Issued on Oct. 29, 1974, to Armstrong teaches a numerical manipulation board game, with: a game board ruled with at least two generally rectangular grid cells of uniform size; at least two playing tiles of uniform size, each being a block having at least two faces upon which the respective block may rest; each block being so shaped that, when both rest on one such face thereof on the game board, the two grid cells are both substantially filled and that, when both rest on another such face thereof and adjacent one another on the game board, one of the grid cells substantially contains both of the playing tiles; indicia on the playing tiles, so located that the indicia is apparent to observers regardless which of the two faces either playing tile rests upon. When the board includes a plurality of cells arranged in a rectangular grid the board game may be used with additional sign tiles to construct interlocking mathematical equations vertically, horizontally and diagonally on the grid.

A THIRD EXAMPLE, U.S. Patent Office Document U.S. Pat. No. 3,895,456, Published/Issued on Jul. 22, 1975, to Fabre teaches a composition assembly, comprising constructional elements for forming toys, educational games, articles for window dressing, furnishings and decoration; some of said elements are rigid, some are flexible and cuttable, shaped as sheets or tridimensional bodies, having protruding peg-and-socket members, and/or hollows and/or holes to interengage each other. Said constructional elements are removably or fixedly composable by nesting one or more of said members on an element in corresponding hollows or holes on another element, or on the same element.

A FOURTH EXAMPLE, U.S. Patent Office Document U.S. Pat. No. 4,955,615, Published/Issued on Sep. 11, 1990, to Eck teaches a set of hexagonal playing pieces, of a shape which when played side to side in beehive pattern create a base, for successive interlocking levels of play. Each player attempts to place his tiles in the most strategically advantageous position.

A FIFTH EXAMPLE, U.S. Patent Office Document No. 20050130726, Published/Issued on Jun. 16, 2005, to Stewart teaches a puzzle game in which game play creates different pictures or designs by assembling the constituent pieces in different arrangements. In one embodiment, a tray is configured to hold a set number of pieces that are generally cube-shaped blocks. Individual sides of the blocks desirably display different colors. Different blocks, or group of blocks, may carry different sets of colors to provide numerous color choices for visible display. A mosaic picture may be formed by arranging blocks in the tray to orient a specific colored side of each block for visible display at a designated location. The resulting picture may be displayed in the tray by hanging the tray from a wall or propping the tray to a substantially vertical orientation. Alternatively, the assembled picture or design may form a playing surface of a board game.

It is apparent now that numerous innovations for table games have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a tile alignment and matching game that avoids the disadvantages of the prior art.

ANOTHER OBJECT of the present invention is to provide a tile alignment and matching game that is simple and inexpensive to manufacture.

STILL ANOTHER OBJECT of the present invention is to provide a tile alignment and matching game that is simple to use.

BRIEFLY STATED, STILL YET ANOTHER OBJECT of the present invention is to provide a set of tiles interconnecting to each other in a continuous end-to-end manner. Each tile has a body. The body of each tile has a specific amount of through bores, a pair of blind bores, and a pair of pins. A pin of the body of one tile sits in a blind bore of the body of another tile. A portion of the specific amount of through bores in the body of the one tile align(s) with a similar portion of the specific amount of through bores in the body of the another tile.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows:

FIGS. 9A-9C is a flowchart of the game method utilizing a set of tiles interconnecting to each other in a continuous end-to-end manner.

A MARSHALING OF REFERENCE NUMERALS UTILIZED IN THE DRAWING

Figure 1:
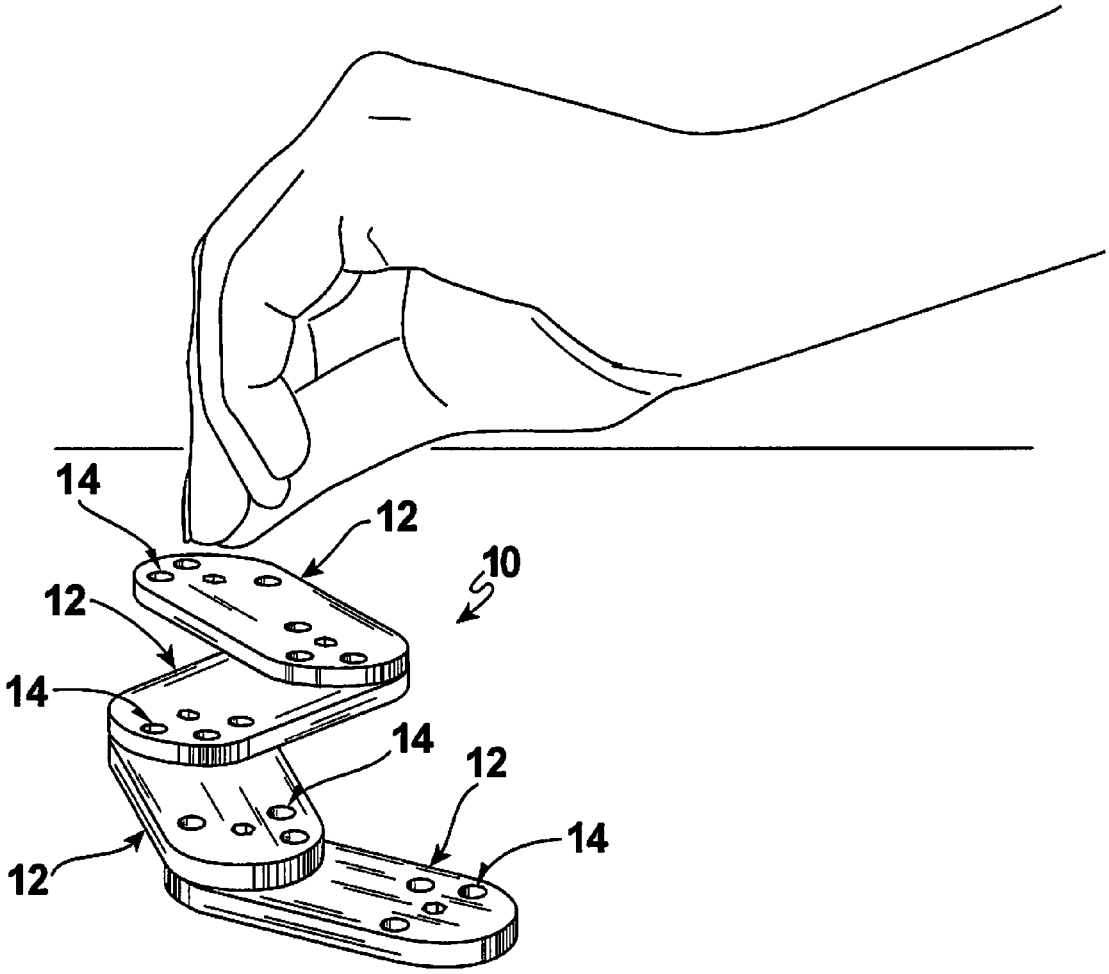
FIG. 1 is a diagrammatic perspective view illustrating the tile alignment and matching game in use by a player.

10 set of tiles of embodiments of present invention interconnecting to each other in a continuous end-to-end manner
12 body of each tile of set of tiles 10
14 specific amount of through bores of body 12 of each tile of set of tiles 10
16 pair of blind bores of body 12 of each tile of set of tiles 10
18 pair of pins of body 12 of each tile of set of tiles 10
20 pair of parallel and straight long sides of body 12 of each tile of set of tiles 10
22 pair of convex short sides of body 12 of each tile of set of tiles 10
24 flat top face of body 12 of each tile of set of tiles 10
26 flat bottom face of body 12 of each tile of set of tiles 10
28 center of each convex short side of pair of convex short sides 22 of body 12 of each tile of set of tiles 10
30 pair of imaginary circles of specific amount of through bores 14 in body 12 of each tile of set of tiles 10
32 center of each imaginary circle of pair of imaginary circles of specific amount of through bores 14 in body 12 of each tile of set of tiles 10

DETAILED DESCRIPTION OF THE PREFERRED EMBODIMENT

Figure 2:
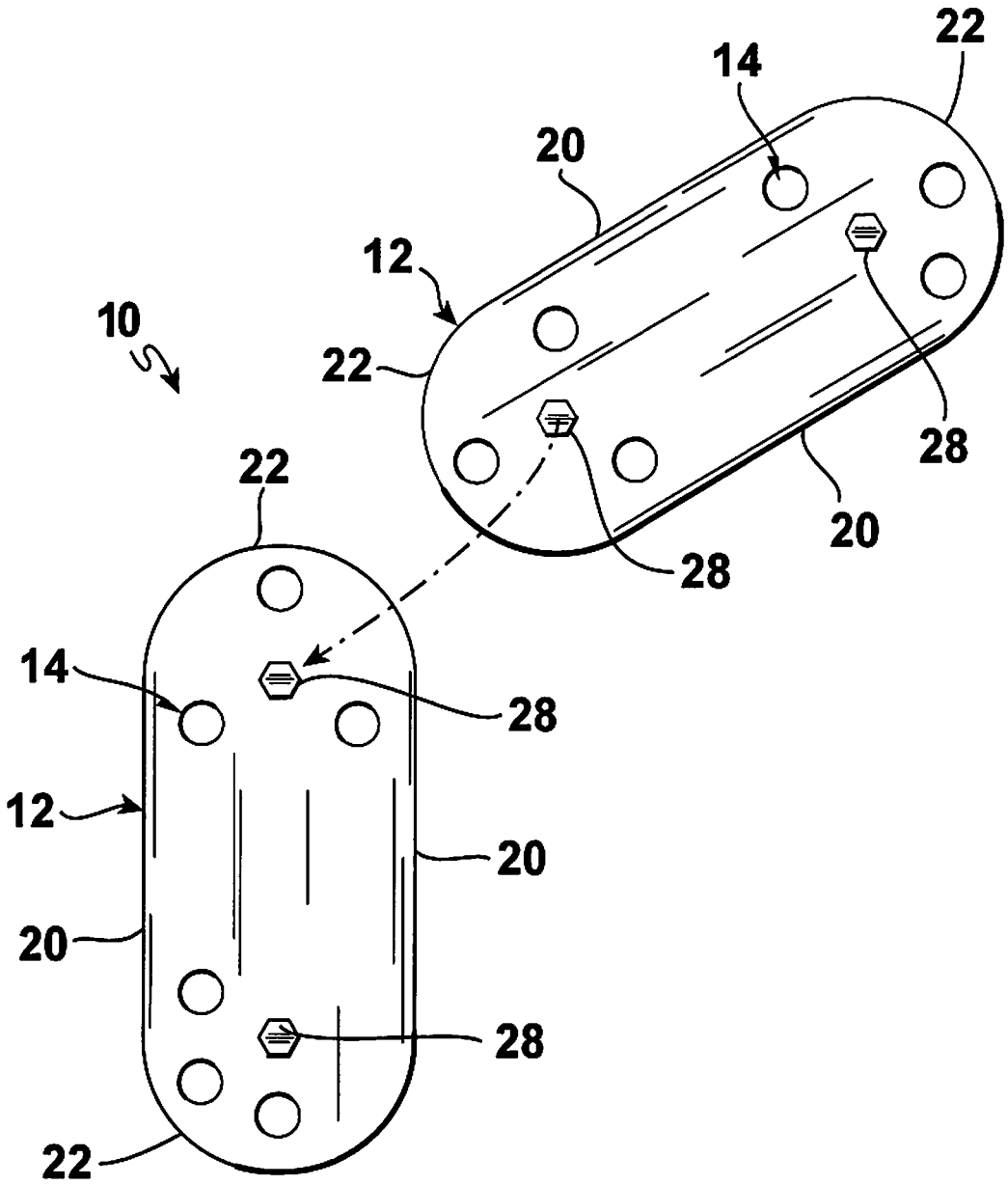
FIG. 2 is a diagrammatic plan view showing two typical tiles with one about to be attached to the other.
Figure 3:
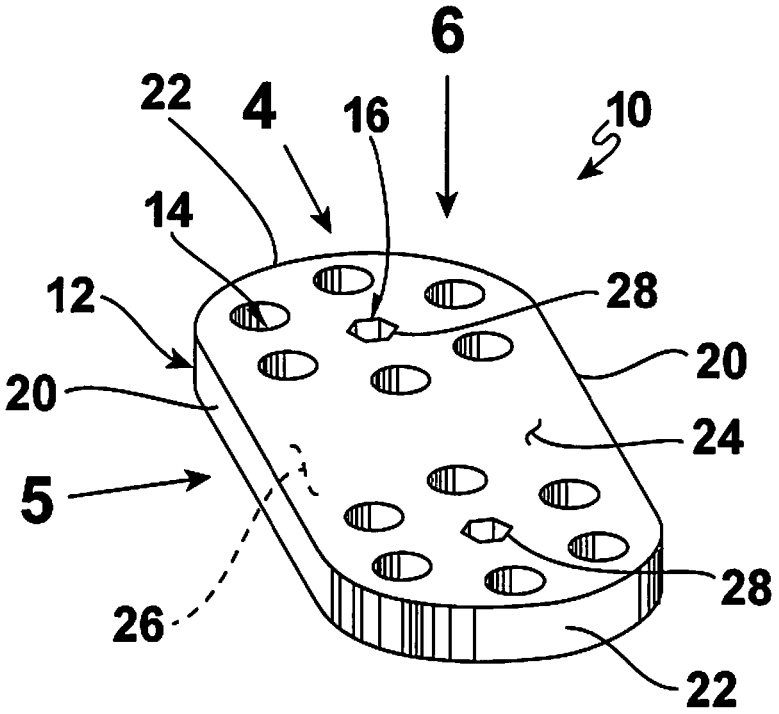
FIG. 3 is a diagrammatic perspective view of a single tile which happens to have six round holes in each end.
Figure 4:
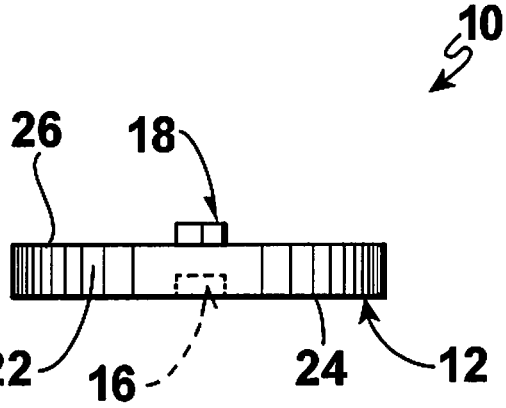
FIG. 4 is an end elevational view taken in the direction of arrow 4 in FIG. 3.
Figure 5:
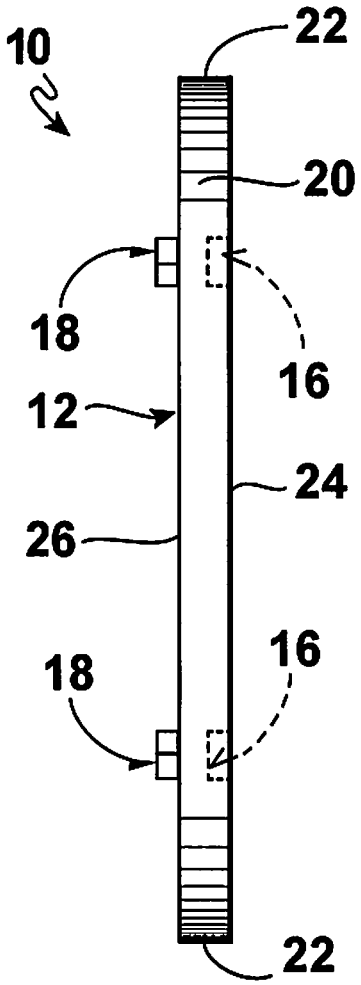
FIG. 5 is a side elevational view taken in the direction of arrow 5 in FIG. 3.
Figure 6:
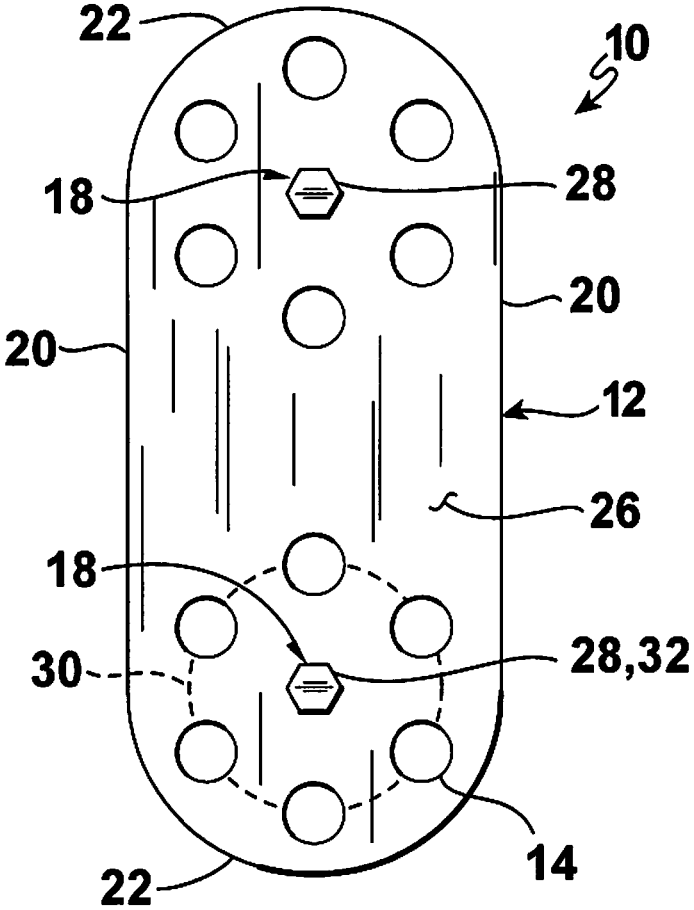
FIG. 6 is an plan view taken in the direction of arrow 6 in FIG. 3.

Referring now to the figures, in which like numerals indicate like parts, and particularly to FIGS. 1 and 2, the set of tiles of the embodiments of the present invention are shown generally at 10 interconnecting to each other in a continuous end-to-end manner.

As shown in FIGS. 1-7, each tile 10 has a body 12. The body 12 of each tile 10 has a specific amount of through bores 14, a pair of blind bores 16, and a pair of pins 18. A pin 18 of the body 12 of one tile 10 sits in a blind bore 16 of the body 12 of another tile 10, with a portion of the specific amount of through bores 14 in the body 12 of the one tile 10 aligning with a similar portion of the specific amount of through bores 14 in the body 12 of the another tile 10.

The body 12 of each tile 10 is oblong-shaped (elliptic, but with parallel sides) and has a pair of parallel and straight long sides 20, a pair of convex short sides 22, a flat top face 24, and a flat bottom face 26.

The specific amount of through bores 14 of the body 12 of each tile 10 are located adjacent to the pair of convex short sides 22 of the body 12 of an associated tile 10, respectively.

Each convex short side 22 of the body 12 of each tile 10 is semi-circular-shaped with a center 28.

The pair of blind bores 16 of the body 12 of each tile 10 are disposed on the flat top face 24 of the body 12 of an associated tile 10, at the centers 28 of the pair of convex short sides 22 of the body 12 of the associated tile 10, respectively.

The pair of pins 18 of the body 12 of each tile 10 are disposed on the flat bottom face 26 of the body 12 of an associated tile 10, at the centers 28 of the pair of convex short sides 22 of the body 12 of the associated tile 10, respectively.

The specific amount of through bores 14 in the body 12 of each tile 10 lie on a pair of imaginary circles 30 having centers 32.

The centers 32 of the specific amount of through bores 14 in the body 12 of each tile 10 coincide with the centers 28 of the pair of convex short sides 22 of the body 12 of the associated tile 10, respectively.

Each blind bore 16 of the body 12 of each tile 10 is hexagonal-shaped in plan view.

Figure 7:
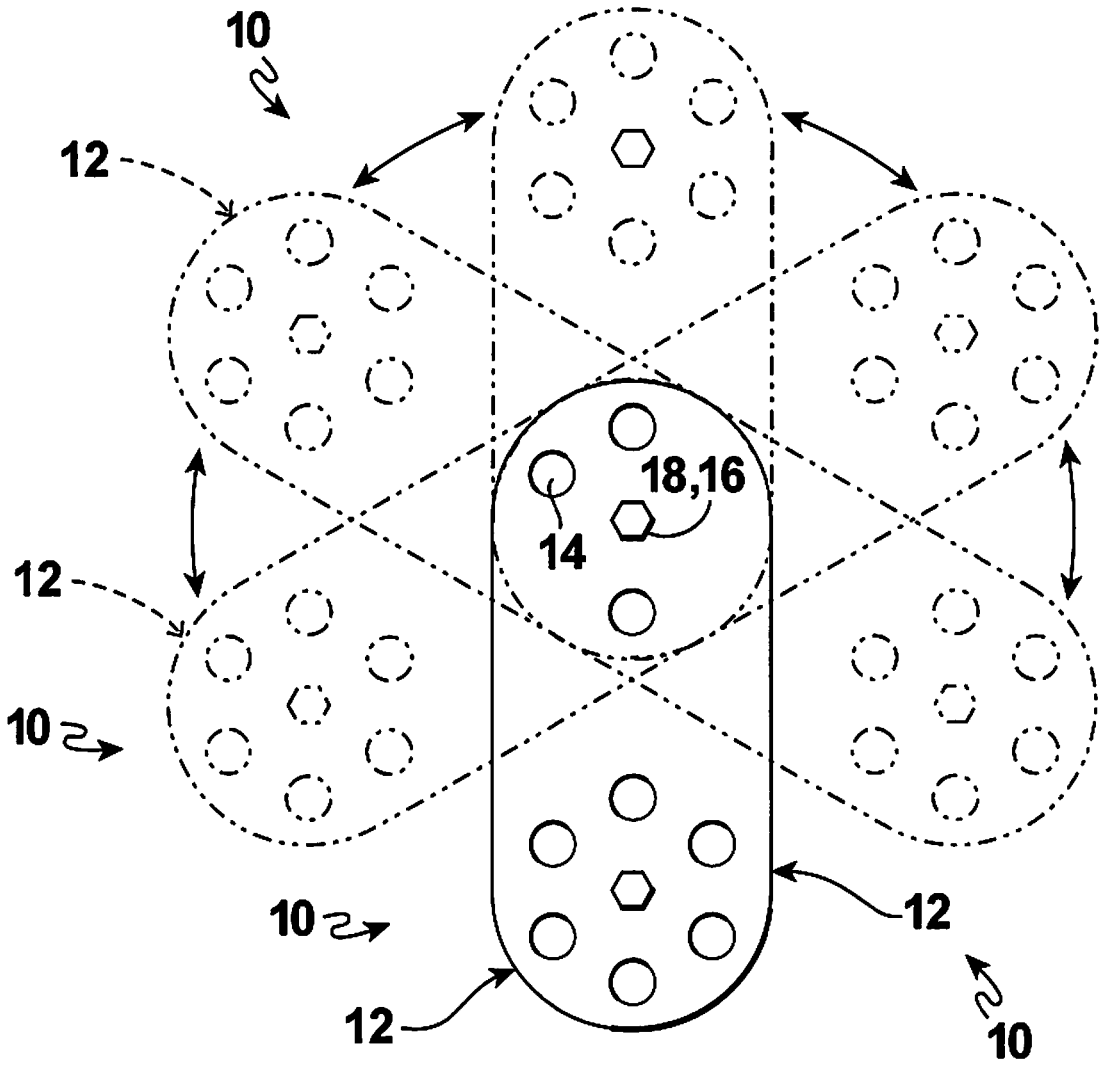
FIG. 7 illustrates all the allowable position tiles can be attached together when the game is being played.

Each pin 18 of the body 12 of each tile 10 is hexagonal-shaped in plan view similar to that of each blind bore 16 of the body 12 of each tile 10 so as to allow, as shown in FIG. 7, a pin 18 of the body 12 of one tile 10 to fit into a blind bore 16 of the body 12 of another tile 10 in a number of different positions by rotating the one tile 10 relative to the another tile 10 before engagement therewith until a portion of the specific amount of through bores 14 in the body 12 of the one tile 10 align with a similar portion of the specific amount of through bores 14 in the body 12 of the another tile 10, and then engaging the pin 18 of the body 12 of the one tile 10 into the blind bore 16 of the body 12 of the another tile 10 and thereby prevent further relative rotation between the one tile 10 and the another tile 10.

Figure 8:
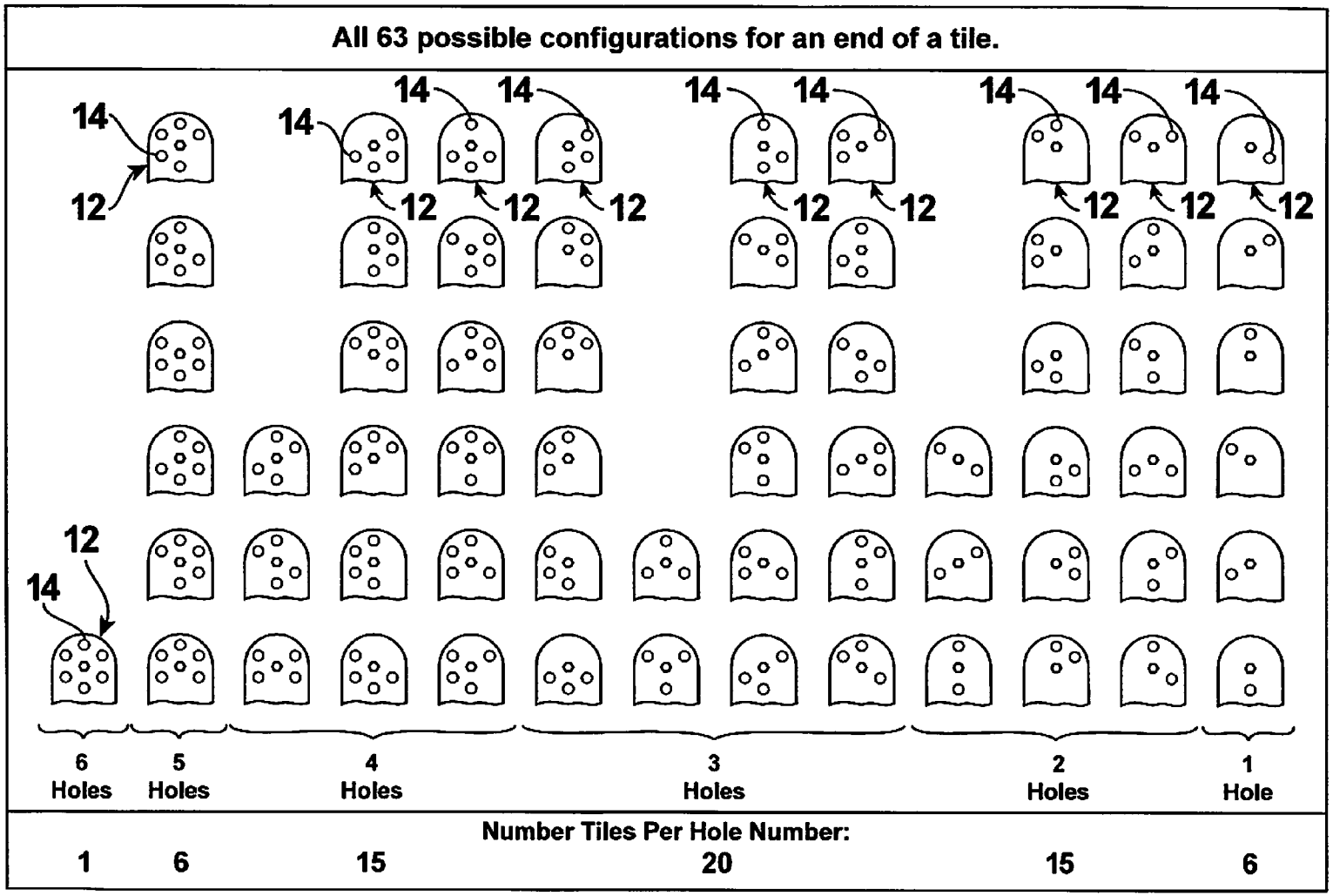
FIG. 8 is a chart showing all the 63 possible hole placement configuration that can exist for one end of a tile having 6 possible hole locations. Accordingly there are total of $63^2$=3969 distinct tiles which may be fabricated when all hole combinations are utilized to form a complete set of all possible tile configurations.

FIG. 8 illustrates the different quantities of the specific amount of through bores 14 of the body 12 of each tile 10. The specific amount of through bores 14 of the body 12 of each tile 10 are in a range of 2-12 through bores.

As shown in FIGS. 9A-9C, the game method utilizing the set of tiles 10 comprises the steps of:

STEP 1: Give each player, by a dealer, an equal number of tiles 10 so as to form player tiles 10;
STEP 2: Leave remaining tiles 10 in a pile on a table so as to form remaining tiles 10;
STEP 3: Select a tile 10 from the remaining tiles 10, by the dealer, at random so as to form a random tile 10;
STEP 4: Place the random tile 10, by the dealer, on the table;
STEP 5: Attempt to match, by a next player, the specific amount of through bores 14 in one convex short side 22 of the body 12 of the player tile 10 to that of the random tile 10 placed on the table;
STEP 6: Determine if a match can be made between the player tile 10 and the random tile 10;
STEP 7: If yes, the next player has one less player tile 10;
STEP 8: If no, either the next player picks up one remaining tile 10 from the pile on the table and has one more player tile 10 or optionally, a timer is set for allowing any player to match the random tile 10; and
STEP 9: Return to step 5 until one player has no more player tiles 10 or all the remaining tiles 10 in the pile on the table are gone in which case the player with the least amount of player tiles 10 wins.

It will be understood that each of the elements described above, or two or more together, may also find a useful application in other types of constructions differing from the types described above.

While the invention has been illustrated and described as embodiments of a tile alignment and matching game, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A set of tiles interconnecting to each other in a continuous end-to-end manner, comprising:

each tile has a body;

said body of each tile has:

a) a specific amount of through bores;

b) a pair of blind bores; and c) a pair of pins;

wherein a pin of said body of one tile sits in a blind bore of said body of another tile; and wherein a portion of said specific amount of through bores in said body of said one tile align with a similar portion of said specific amount of through bores in said body of said another tile;

wherein each blind bore of said body of each tile is hexagonal-shaped in plan view.

2. The set of tiles interconnecting to each other in a continuous end-to-end manner of claim 1, wherein said body of each tile is oblong-shaped.

3. The set of tiles interconnecting to each other in a continuous end-to-end manner of claim 1, wherein said body of each tile has a pair of parallel and straight long sides.

4. The set of tiles interconnecting to each other in a continuous end-to-end manner of claim 1, wherein said body of each tile has a pair of convex short sides.

5. The set of tiles interconnecting to each other in a continuous end-to-end manner of claim 4, wherein said specific amount of through bores of said body of each tile are located adjacent to said pair of convex short sides of said body of an associated tile.

6. The set of tiles interconnecting to each other in a continuous end-to-end manner of claim 4, wherein each convex short side of said body of each tile is semi-circular-shaped with a center.

7. The set of tiles interconnecting to each other in a continuous end-to-end manner of claim 6, wherein said pair of blind bores of said body of each tile are disposed at said centers of said pair of convex short sides of said body of an associated tile, respectively.

8. The set of tiles interconnecting to each other in a continuous end-to-end manner of claim 6, wherein said pair of pins of said body of each tile are disposed at said centers of said pair of convex short sides of said body of an associated tile, respectively.

9. The set of tiles interconnecting to each other in a continuous end-to-end manner of claim 6, wherein said specific amount of through bores in said body of each tile lie on a pair of imaginary circles having centers that coincide with said centers of said pair of convex short sides of said body of an associated tile, respectively.

10. The set of tiles interconnecting to each other in a continuous end-to-end manner of claim 1, wherein said body of each tile has a flat top face.

11. The set of tiles interconnecting to each other in a continuous end-to-end manner of claim 10, wherein said pair of blind bores of said body of each tile are disposed on said flat top face of said body of an associated tile.

12. The set of tiles interconnecting to each other in a continuous end-to-end manner of claim 1, wherein said body of each tile has a flat bottom face.

13. The set of tiles interconnecting to each other in a continuous end-to-end manner of claim 12, wherein said pair of pins of said body of each tile are disposed on said flat bottom face of said body of an associated tile.

14. The set of tiles interconnecting to each other in a continuous end-to-end manner of claim 1, wherein each pin of said body of each tile is hexagonal-shaped in plan view similar to that of each blind bore of said body of each tile so as to allow a pin of said body of one tile to fit into a blind bore of said body of another tile in a number of different positions by rotating said one tile relative to said another tile before engagement therewith until a portion of said specific amount of through bores in said body of said one tile align with a similar portion of said specific amount of through bores in said body of said another tile, and then engaging to thereby prevent further relative rotation between said one tile and said another tile.

15. The set of tiles interconnecting to each other in a continuous end-to-end manner of claim 1, wherein said specific amount of through bores said body of each tile are in a range of 2-12 through bores.

* * * * *